US006056161A

United States Patent [19]

Brown et al.

[11] Patent Number: 6,056,161

[45] Date of Patent: May 2, 2000

[54] PUSH-PULL DISPENSER

[75] Inventors: Robert Brown, Wheeling; Gene Dorsch, Long Grove; Valentin Hierzer, Arlington Hts.; Robert Simpson, Grayslake, all of Ill.

[73] Assignee: Crown Cork & Seal Technologies Corporation, Alsip, Ill.

[21] Appl. No.: 09/141,658

[22] Filed: Aug. 28, 1998

Related U.S. Application Data

[63] Continuation of application No. 09/047,812, Mar. 25, 1998, abandoned.

[51] Int. Cl.[7] ..... B67D 3/00

[52] U.S. Cl. ..... 222/153.14; 222/525; 222/520

[58] Field of Search ..... 222/153.14, 519, 222/520, 522, 525, 552, 553, 559

[56] References Cited

U.S. PATENT DOCUMENTS

| | | | |
|---|---|---|---|
| 2,345,737 | 4/1944 | Fabrice | 222/522 X |
| 2,877,918 | 3/1959 | Gardner | 222/522 |
| 3,121,519 | 2/1964 | Cherba | 222/519 |
| 3,248,025 | 4/1966 | Santore | 222/520 X |
| 3,261,513 | 7/1966 | Moran | 222/553 X |
| 3,351,249 | 11/1967 | Stull | 222/520 |
| 3,542,258 | 11/1970 | Marchant | 222/520 |
| 4,295,584 | 10/1981 | Borowitz | 222/519 |
| 4,799,598 | 1/1989 | McFadyen . | |
| 4,927,065 | 5/1990 | Beck | 222/520 |
| 5,038,967 | 8/1991 | Braun | 222/519 |
| 5,104,008 | 4/1992 | Crisci | 222/525 X |
| 5,110,017 | 5/1992 | Braun | 222/520 |
| 5,111,967 | 5/1992 | Schreiber | 222/39 |
| 5,456,374 | 10/1995 | Beck | 222/559 X |
| 5,465,876 | 11/1995 | Crisci | 222/525 X |
| 5,810,185 | 9/1998 | Groesbeck | 222/525 X |

FOREIGN PATENT DOCUMENTS 417 891 3/1991 European Pat. Off. .

*Primary Examiner*—Kenneth Bomberg
*Attorney, Agent, or Firm*—Woodcock Washburn Kurtz Mackiewicz & Norris LLP

[57] ABSTRACT

A single piece push-pull dispenser for sealing water, juice, detergent containers and the like is provided. The push-pull dispenser has a tubular skirt sized to longitudinally adjustably engage the exterior sidewall of a container neck, and a cylindrical plug disposed within the tubular skirt, sized to engage and seal the mouth of the container neck. The outside perimeter of the cylindrical plug and the inside wall of the tubular skirt are spaced, defining an annular orifice. The cylindrical plug is connected to the tubular skirt by at least one spoke connector which bridges the annular orifice. The push-pull dispenser is longitudinally adjustable along the container neck so that in its lower, closed position, the cylindrical plus seals the container neck. In an upper, open position, the cylindrical plug disengages and unseals the neck permitting the contents to flow through the annular orfice.

17 Claims, 3 Drawing Sheets

PUSH-PULL DISPENSER

This is a continuation of U.S. application Ser. No. 09/047,812, filed Mar. 25, 1998, now abandoned.

BACKGROUND

This invention relates to a single piece push-pull dispenser container closure which is opened and closed by moving the push-pull dispenser longitudinally along the container neck permitting the container contents to be poured without removing the push-pull dispenser closure from the container.

Push-pull dispensers are known in the art, have been employed in a wide variety of products from water and juice bottles, to condiment and detergent bottles, and have gained wide acceptance in the marketplace. Their wide acceptance and usage are the results of several important advantages over traditional non-dispensing closures. Notably, push-pull dispensers permit the container to be opened and closed without removing or separating any portion of the push-pull dispenser from the container. Thus, the container can usually be held and the push-pull dispenser opened and closed with one hand. Further, since the push-pull dispenser is not removed when opening and closing the container it is unlikely to be lost or misplaced. These features of push-pull dispensers are particularly advantageous for single serving beverage containers wherein the user can drink directly from the dispenser, using only one hand or their mouth to open and close the container while exercising, driving or engaging in like activity.

The known push-pull dispenser closures are constructed from two interlocking pieces, a bottom piece attached to the container neck and a top piece slidably engaging the bottom piece. The bottom piece comprises a donut-shaped top having a center hole, an upwardly depending annular skirt along the periphery of the hole, and a downwardly depending annular skirt from the perimeter of the top. The downwardly depending annular skirt is adapted with a securement means such as threads or the like for securing the closure to the container neck. Disposed within the upwardly depending annular skirt is an elevated cylinder which is joined by connectors therebetween. The outside wall of the elevated cylinder and the inside wall of the upwardly depending skirt define a donut-shaped orifice in the bottom piece.

The top piece comprises an annular skirt having upper and lower portions and acts as a cap over the donut-shaped orifice of the bottom piece. The upper portion has an orifice sized to engage the elevated cylindrical portion of the bottom piece. The lower portion is sized to fit over and slidably engage the upwardly depending skirt of the bottom piece whereby it can be raised and lowered. In its lower, closed position, the elevated cylinder plugs the orifice of the top piece preventing release of the container contents. In the upper, open position, the elevated cylinder disengages the orifice of the top piece, permitting the fluid to flow through the donut-shaped orifice of the lower piece and out the orifice in the top piece.

Although the push-pull dispensers of this known design have gained wide acceptance and usage, and provide several advantages over conventional non-dispensing closures, these advantages are realized at a higher cost and some loss of function. Manufacturing costs are higher, in comparison with conventional non-dispensing closures due to the two piece construction of known designs. Function is lost in that the fluid flow orifice of known push-pull dispensers is necessarily smaller than the fluid flow orifice defined by the mouth of the container. The smaller orifice results in lower flow rates. Further, the small diameter of the orifice results in flooding of the outlet orifice. Flooding of the outlet orifice prevents back flow of air into the container to replace the dispensing liquid. When the back flow of air is restricted, a negative pressure or a vacuum develops inside the container, inhibiting or preventing outward flow of the container contents. In this respect, containers sealed with known push-pull dispensers ordinarily require that the user either squeeze the container to increase the pressure inside the container or frequently tip the container upright to permit the back flow of air into the container.

For the foregoing reasons, there is a need for a push-pull closure which is cheaper to manufacture, provides increased flow rates and alleviates vacuum formation.

SUMMARY OF THE INVENTION

The invention herein solves these problems by (1) providing a single piece push-pull dispenser so that the manufacturing cost is substantially, reduced when compared with the manufacturing cost of known two piece push-pull closures, and (2) providing a large diameter annular orifice so that the entire orifice will not ordinarily be flooded or submerged when dispensing the container contents and fluid flow rates can be increased.

According to the present invention, there is provided a push-pull dispenser comprising a tubular skirt, a cylindrical plug and at least one spoke connector. The tubular skirt is adapted to provide a liquid tight longitudinally adjustable engagement means with the exterior sidewall of the container neck. The engagement means may be provided by any known means. Some known means include, but are not limited to, a frictionally engaging annular flange, interengaging screw threads, or a plurality of interengaging annular ribs or channels. The cylindrical plug is disposed within the tubular skirt and is spaced from the tubular skirt so that the inner surface of the tubular skirt and the perimeter of the cylindrical plug define an annular orifice. The cylindrical plug is joined to the tubular skirt and supported therein by it least one spoke connector bridging the annular orifice.

The push-pull dispenser of the present invention operates by longitudinally traversing the container neck between a lower, closed position and an upper, open position. In the lower, closed position, the cylindrical plug of the push-pull dispenser engages and seals the mouth of the container neck. As the push-pull dispenser is raised to its upper, open position, the cylindrical plug disengages and unseals the container neck, forming an annular gap between the cylindrical plug and the container neck, and proving a path from the interior of the container to the annular orifice. As the container is tipped, its contents flow through the annular gap and out the annular orifice of the push-pull dispenser. The container is resealed simply by moving the push-pull dispenser back to its closed position.

The push-pull dispenser of the present invention provides the stated advantages over known closures, namely, inexpensive manufacture and increased function. The push-pull dispenser is inexpensively manufactured as a single piece component from plastic such as polyethylene, polypropylene or the like, significantly reducing manufacturing costs over the known two piece push-pull dispensers. The function is increased by the large annular orifice permitted by the present invention. The push-pull dispenser herein permits the diameter of annular orifice to be substantially equal to the diameter of the container neck, providing a larger orifice and increased fluid flow over known push-pull closures.

Further, since the annular orifice of the present invention spans the full diameter of the container neck, only a portion of the annular orifice ordinarily becomes filled or submerged during dispensing. Thus, as the container and corresponding orifice of the push-pull dispenser are tipped to dispense the contents, the contents will begin pouring out through the lowest portion of the annular orifice, permitting the back flow of air into the container through the higher portion. The back flow of air prevents the formation of a vacuum within the container, alleviating the need to squeeze the container or frequently upright the container, as must be done with previously known push-pull dispensers.

Further embodiments of the present invention contemplate that the push-pull dispenser may also be provided with a dust cover having a top and a depending annular skirt sized to fit over the push-pull dispenser. The dust cove is effective in keeping the push-pull dispenser clean. It is further contemplated that the push-pull dispenser or dust cover may be provided with a tear-off or frangibly connected tamper evident seal providing visual evidence of tampering.

These and other features, aspects, and advantages of the present invention will become better understood with regard to the following description, appended claims, and accompanying drawings.

DETAILED DESCRIPTION

Figure 1:
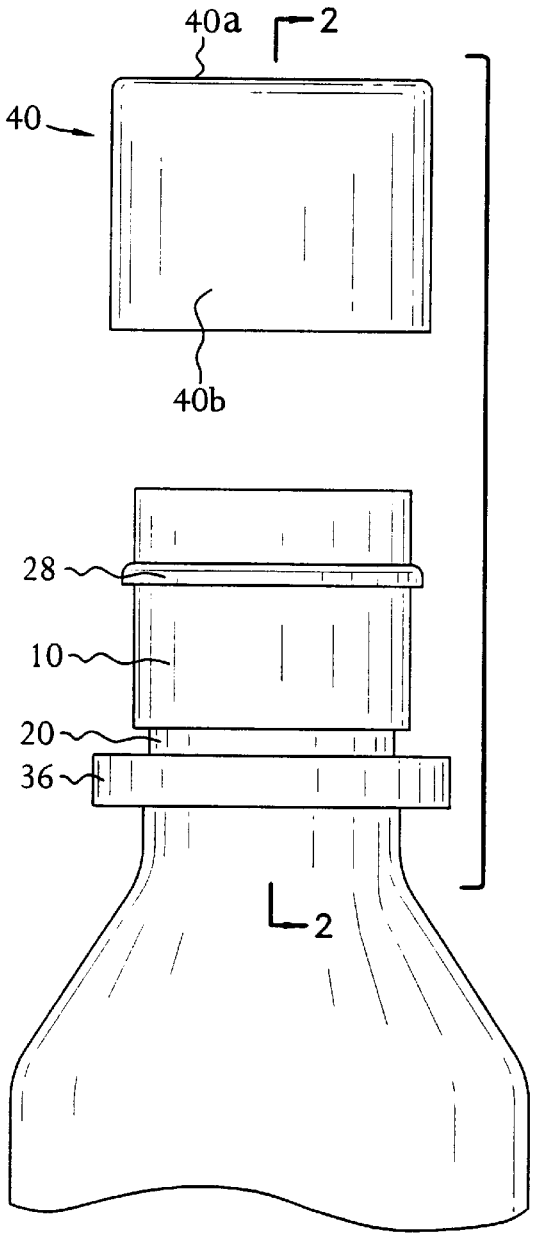
FIG. 1 shows a side elevation view of the push-pull dispenser with the dust cover removed.

Referring to FIGS. 1–7, an integrally molded plastic push-pull dispenser is provided for sealing beverage, condiment, soap containers and the like. FIGS. 2 and 4–7 provide cross-sectional views of the push-pull dispenser along line 2–2 of FIG. 1. Referring to FIGS. 2–7, the push-pull dispenser is shown comprising a tubular skirt 10 having an inner surface 10*b* and an outer surface 10*a*, a cylindrical plug 12, and spoke connectors 14 joining the tubular skirt 10 to the cylindrical plug 12.

The cylindrical plug 12 is concentrically disposed within the tubular skirt 10 and sized to engage and seal the container neck 20. The perimeter of the cylindrical plug 12 is spaced from the inner surface 10*b* of the tubular skirt 10, so that the perimeter of the cylindrical plug 12 and the opposing inner surface 10*b* of the tubular skirt 10 define an annular orifice 24. The annular orifice 24 is segmented by spoke connectors 14 which bridges the annular orifice 24 and rigidly connect the cylindrical plug 12 to the tubular skirt 10. The spoke connectors must provide sufficient strength so that the cylindrical plug 12 is substantially fixed in relation to the tubular skirt. It is contemplated that a brace 22 may be employed to strengthen the spoke connectors 14.

The inner surface 10*b* of the tubular skirt 10 is adapted to provide a liquid tight longitudinally adjustable engagement means with the exterior sidewall of a container neck 20, whereby the tubular skirt 10 can longitudinally traverse the container neck 20. The engagement means are preferably provided by an annular flange 18, disposed around the exterior sidewall of the container neck 20, which frictionally engages the inner surface 10*b* of the tubular skirt 10, permitting the push-pull disperser to slidably traverse the container neck. Although the frictionally engaging annular flange 18 is the preferred means, it is contemplated that other known means will work equally as well. For example, referring to FIG. 6, the inside surface 10*b* of the tubular skirt 10 and the exterior sidewall of the container neck 20 may be provided with interengaging screw threads 32 so that the push-pull dispenser longitudinally traverses the container neck as it is screwed on and off. Alternatively, referring to FIG. 7, the inside surface 10*b* of the tubular skirt 10 and the exterior sidewall of the container neck 20 may be provided with a plurality of interengaging of longitudinally spaced annular ribs 34 so that the push-pull dispenser can be snapped into a plurality of longitudinal positions along the container neck 20.

Figure 2:
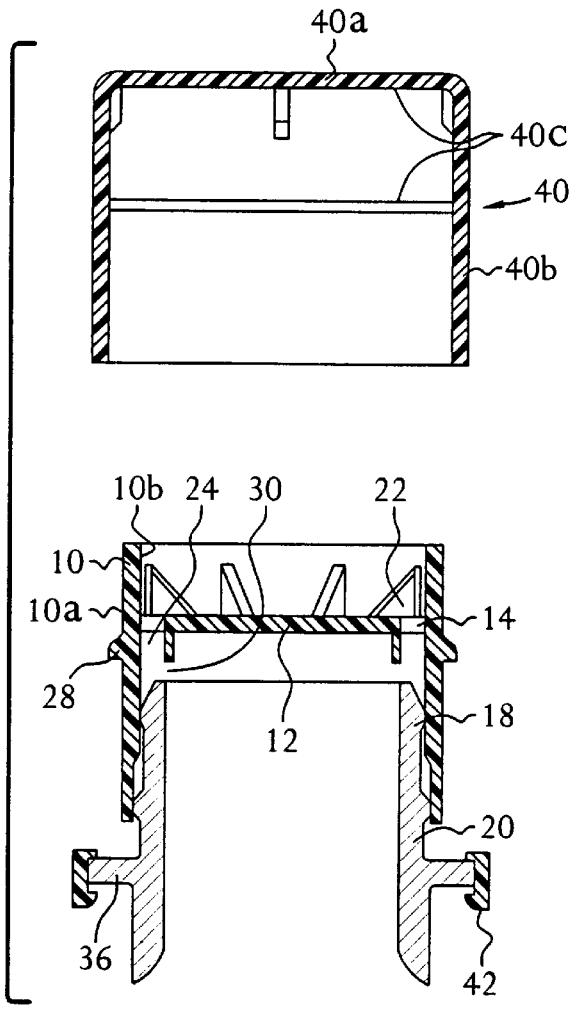
FIG. 2 shows a cross-sectional view of the push-pull dispenser in an open position with the dust cover removed.
Figure 3:
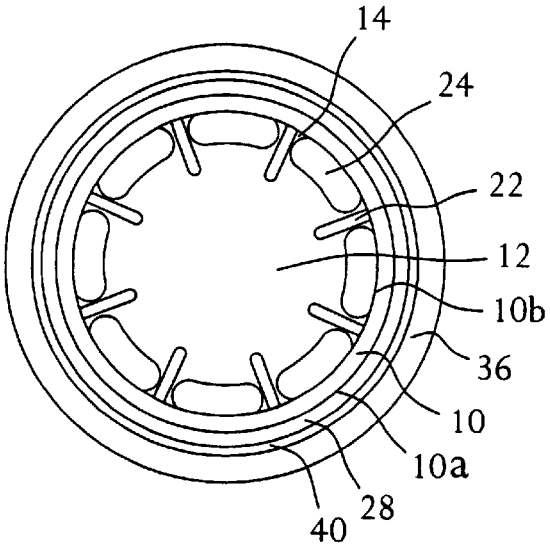
FIG. 3 shows a top plan view of the push-pull dispenser.
Figure 5:
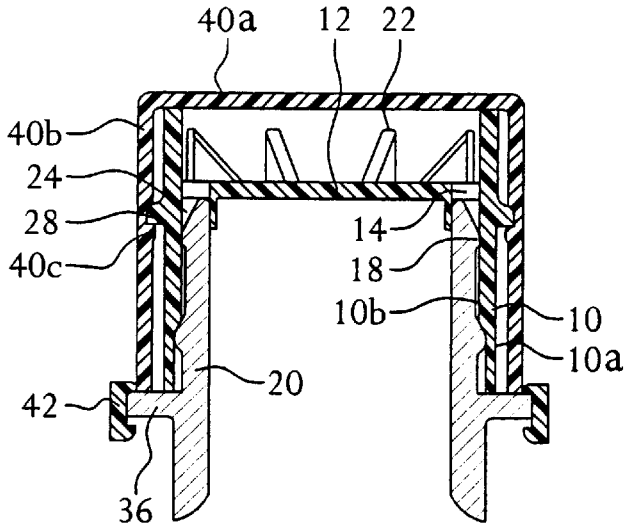
FIG. 5 shows a cross-sectional view of the push-pull dispenser in a closed position with the dust cover in place.
Figure 4:
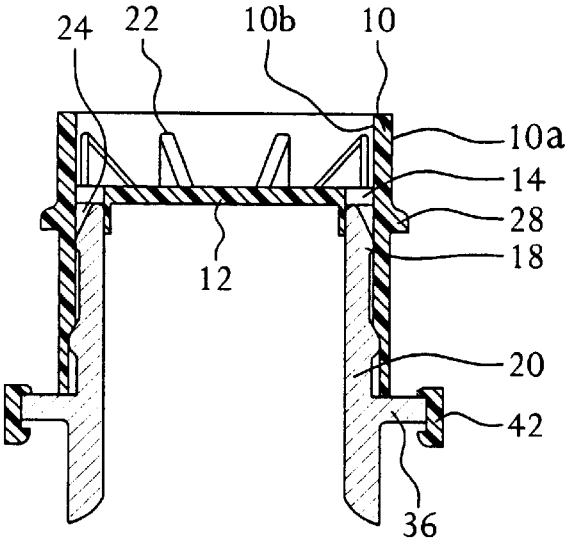
FIG. 4 shows a cross-sectional view of the push-pull dispenser in a closed position with the dust cover removed.
Figure 6:
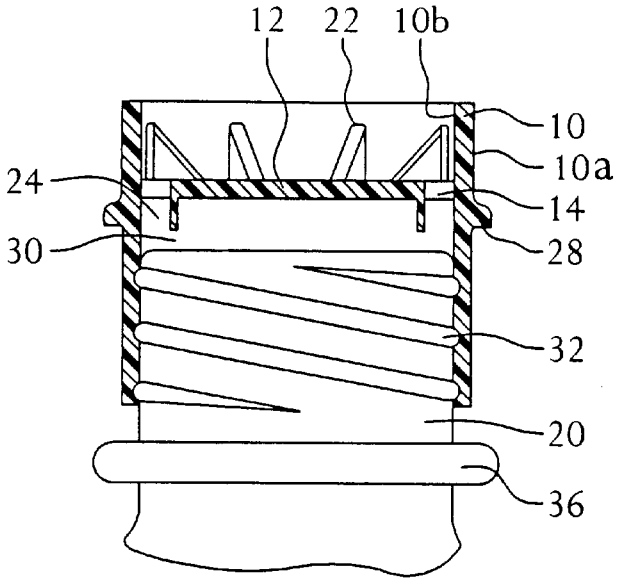
FIG. 6 show a cross-sectional view of a first alternate embodiment of the push-pull dispenser.
Figure 7:
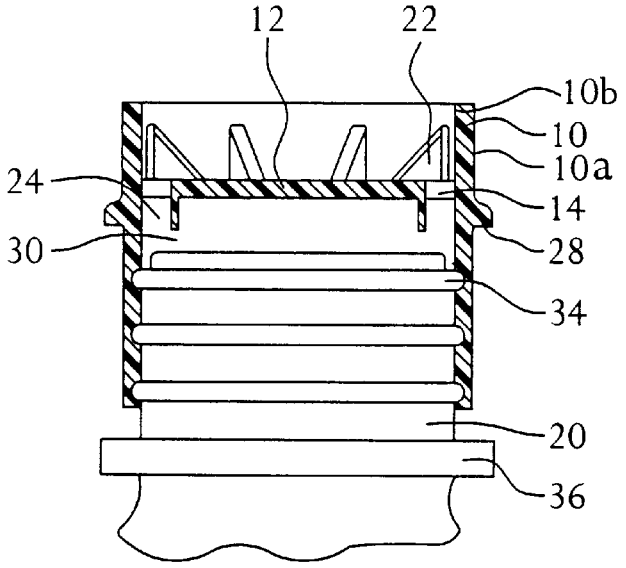
FIG. 7 show a cross-sectional view of a second alternate embodiment of the push-pull dispenser.

In use, the push-pull dispenser is operated by moving the dispenser longitudinally along the container neck 20 from a lower, closed position to and upper, open position. Referring to FIG. 4 and 5, the push-pull dispenser is shown in its lower, closed position with the cylindrical plug 12 engaging and sealing the container neck 20. Referring to FIG. 2, as the push-pull dispenser is moved longitudinally, traversing the container neck toward the upper, open position, the cylindrical plug, 12 disengages and unseals the container neck 20. As the cylindrical plug 12 disengages the container neck 20, an annular gap 30 opens between the cylindrical plug 12 and the container neck 20, providing an outlet from the interior of the container to the annular orifice 24 in the push-pull dispenser. By adjusting the longitudinal position of the push-pull dispenser, the annular gap 30 between the cylindrical plug 12 and the container neck 20 can be adjusted so that the flow rate can be varied. With the push-pull dispenser in an upper, open position, the container contents can pass through the annular gap 30 and out the annular orifice 24 as the container is tipped. It is preferable that the container be tipped at a moderate angle so that the container contents pass through only the lower portion of the annular orifice 24, permitting air to flow back through the higher portion.

Referring to FIGS. 1, 2 and 5, it is contemplated that alternative embodiments of the push-pull dispenser further include a single piece integrally molded plastic dust cover 40 comprising a top 40*a* and a depending annular skirt 40*b* sized to fit over the push-pull dispenser. The annular skirt 40*b* of the dust cover 40 is preferably adapted with an inwardly extending annular flange 40*c* which engages a corresponding outwardly extending annular flange 28 on the outer surface 10*a* of the tubular skirt 10, so that the dust cover 40 can be snapped onto the push-pull dispenser.

Referring to FIGS. 2, 4 and 5, it is also contemplated that alternative embodiments of the push-pull dispenser may further include a tamper evident band 42 frangibly connect to either the annular skirt 40*b* of the dust cover 40 or to the tubular skirt 10 of the push-pull dispenser. The tamper evident band 42 engages a locking lug 36 on the container neck 20 so that the frangible connection of the tamper evident band 42 breaks the first time the push-pull dispenser is opened.

Although the present invention has been described in considerable detail with reference to certain preferred versions thereof, other versions are possible. Therefore, it should be understood that this invention is in no sense limited by the description of the preferred embodiments and its scope is to be determined by that of the claims.

What is claimed is:

1. A push-pull dispenser for resealably closing a container, comprising:

a tubular skirt having an inner and outer surface, the inner surface being sized to receive a container neck, and having a liquid tight longitudinally adjustable engagement means with the container neck, whereby the tubular skirt can longitudinally traverse the container neck from an upper, open position to a lower, closed position;

a cylindrical plug disposed within the tubular skirt being sized to engage and seal the container neck, the perimeter of the cylindrical plug and the inner surface of the tubular skirt defining an annular orifice; and at least one spoke connector bridging the annular orifice and rigidly joining the cylindrical plug to the tubular skirt so that the cylindrical plug is substantially fixed in relation to the tubular skirt, the at least one spoke connector having an integrally molded brace.

2. The push-pull dispenser as claimed in claim 1, wherein the tubular skirt, the cylindrical plug and the at least one spoke connector are integrally molded from plastic.

3. The push-pull dispenser as claimed in claim 1, further including a dust cover comprising a top and a depending annular skirt sized to received and engage the push-pull dispenser.

4. The push-pull dispenser as claimed in claim 3, wherein the depending annular skirt of the dust cover has an inwardly extending annular flange which is spaced apart from a lower end of the annular skirt and which engages a corresponding outwardly extending annular flange on the outer surface of the tubular skirt, so that the dust cover can be snapped onto the push-pull dispenser.

5. The push-pull dispenser as claimed in claim 3, wherein the annular skirt of the dust cover further includes a depending frangibly connected tamper evident band capable of engaging a locking lug on the container neck.

6. The push-pull dispenser according to claim 1 wherein the inner surface of the tubular skirt lacks threads for engaging the container neck.

7. The push-pull dispenser according to claim 1 wherein the engagement means includes an engagement surface comprising a smooth-walled cylinder.

8. The push-pull dispenser according to claim 7 wherein the engagement surface is threadless and grooveless.

9. The push-pull dispenser of claim 1 wherein the cylindrical plug includes an outer cylindrical sidewall.

10. The push-pull dispenser of claim 9 wherein the outer cylindrical sidewall is insertable into a cylindrical neck inner wall.

11. A push-pull dispenser for resealably closing a container, comprising:

a tubular skirt having an inner and outer surface, the inner surface being sized to receive a container neck, and having a liquid tight longitudinally adjustable cylindrical engagement wall engagable with the container neck, the tubular skirt capable of only longitudinally moving relative to the container neck from an upper, open position to a lower closed position;

a cylindrical plug disposed within the tubular skirt sized to engage and seal the container neck, the perimeter of the cylindrical plug and the inner surface of the tubular skirt defining an annular orifice; and at least one spoke connector bridging the annular orifice and rigidly joining the cylindrical plug to the tubular skirt so that the cylindrical plug is substantially fixed in relation to the tubular skirt, the at least one spoke connector having an integrally molded brace.

12. The push-pull dispenser of claim 11 wherein the tubular skirt projects above the cylindrical plug.

13. The push-pull dispenser according to claim 11 wherein the inner surface of the tubular skirt lacks threads for engaging the container neck.

14. The push-pull dispenser of claim 11 wherein the cylindrical plug includes an outer cylindrical sidewall that is insertable into a cylindrical neck inner wall.

15. The push-pull dispenser as claimed in claim 11 further including a dust cover comprising a top and a depending annular skirt sized to received and engage the push-pull dispenser.

16. The push-pull dispenser as claimed in claim 15, wherein the depending annular skirt of the dust cover has an inwardly extending annular flange which engages a corresponding outwardly extending annular flange on the outer surface of the tubular skirt, so that the dust cover can be snapped onto the push-pull dispenser.

17. The push-pull dispenser as claimed in claim 15, wherein the annular skirt of the dust cover further includes a depending frangibly connected tamper evident band capable of engaging a locking lug on the container neck.

* * * * *